US009828154B2

(12) United States Patent
Edwards

(10) Patent No.: US 9,828,154 B2
(45) Date of Patent: Nov. 28, 2017

(54) WEB OF CLEANING PRODUCTS AND METHOD OF MANUFACTURE

(71) Applicant: MONOSOL, LLC, Merrillville, IN (US)

(72) Inventor: David Brian Edwards, Old Town Stevenage (GB)

(73) Assignee: MONOSOL, LLC, Merrillville, IN (US)

( * ) Notice: Subject to any disclaimer, the term of this patent is extended or adjusted under 35 U.S.C. 154(b) by 63 days.

(21) Appl. No.: 14/633,798

(22) Filed: Feb. 27, 2015

(65) Prior Publication Data

US 2016/0251131 A1 Sep. 1, 2016

(51) Int. Cl.
*B65D 65/46* (2006.01)
*B65B 7/02* (2006.01)
(Continued)

(52) U.S. Cl.
CPC ..... *B65D 65/46* (2013.01); *B65B 3/04* (2013.01); *B65B 7/02* (2013.01); *B65B 61/005* (2013.01);
(Continued)

(58) Field of Classification Search
CPC ..... B65D 43/02; B65D 51/18; B65D 75/327; B65D 75/40; B65D 75/44; B65D 65/46;
(Continued)

(56) References Cited

U.S. PATENT DOCUMENTS 5,775,505 A * 7/1998 Vasquez ..... B65D 75/327 206/532
D629,702 S * 12/2010 Caldwell ..... D9/416
(Continued)

FOREIGN PATENT DOCUMENTS

CH 655913 A5 5/1986
DE 102011082207 A1 3/2012
(Continued)

OTHER PUBLICATIONS

Invitation to Pay Additional Fees and Partial International Search Report dated May 4, 2016 by the International Searching Authority in counterpart International Patent Application No. PCT/US2016/019504.

*Primary Examiner* — Chun Cheung
(74) *Attorney, Agent, or Firm* — Marshall, Gerstein & Borun LLP

(57) ABSTRACT

A web of cleaning products and a method of manufacturing the same is disclosed. The web includes a carrier sheet having a plurality of depressions each filled, and in direct contact with, at least one cleaning composition. A plurality of internal lids that correspond with the plurality of depressions are sealed to the carrier sheet in a manner covering the plurality of depressions. Additionally, a plurality of external lids that correspond with the plurality of internal lids are sealed to the carrier sheet and cover the plurality of internal lids. The carrier sheet and external lids may be made of a water-resistant material, and the internal lids may be made of a water-soluble material. In one embodiment, the internal lids may be omitted, and instead the depressions be filled with water-soluble pouches, each of which contains a respective dose of a cleaning composition.

25 Claims, 6 Drawing Sheets

(51) Int. Cl.

| | |
|---|---|
| ***B65D 51/18*** | (2006.01) |
| ***B65B 61/18*** | (2006.01) |
| ***B65D 43/02*** | (2006.01) |
| ***B65B 3/04*** | (2006.01) |
| ***B65B 61/00*** | (2006.01) |
| ***B65D 75/32*** | (2006.01) |
| ***B65D 75/40*** | (2006.01) |
| ***B65D 75/44*** | (2006.01) |
| ***B65D 77/06*** | (2006.01) |
| ***B65D 77/20*** | (2006.01) |
| ***C11D 17/04*** | (2006.01) |

(52) U.S. Cl.
CPC ..... *B65B 61/182* (2013.01); *B65D 43/02* (2013.01); *B65D 51/18* (2013.01); *B65D 75/327* (2013.01); *B65D 75/40* (2013.01); *B65D 75/44* (2013.01); *B65D 77/06* (2013.01); *B65D 77/2024* (2013.01); *C11D 17/049* (2013.01); *B65D 51/185* (2013.01); *B65D 65/466* (2013.01); *B65D 2213/00* (2013.01); *B65D 2215/00* (2013.01); *B65D 2251/009* (2013.01); *B65D 2251/0018* (2013.01); *B65D 2251/0028* (2013.01); *B65D 2251/0031* (2013.01); *B65D 2251/0093* (2013.01); *B65D 2543/00833* (2013.01); *B65D 2575/3227* (2013.01); *B65D 2577/205* (2013.01)

(58) Field of Classification Search
CPC ..... B65B 3/04; B65B 7/02; B65B 61/005; B65B 61/182
USPC ..... 206/528–540, 581
See application file for complete search history.

(56) References Cited

U.S. PATENT DOCUMENTS

| | | | | |
|---|---|---|---|---|
| 2004/0142131 | A1 | 7/2004 | Edwards et al. | |
| 2006/0086640 | A1* | 4/2006 | Luciano, Jr. ..... | A61J 7/0069 206/534 |
| 2008/0009585 | A1 | 1/2008 | Catalfamo | |
| 2009/0134054 | A1* | 5/2009 | Lee ..... | B65B 9/04 206/531 |
| 2010/0065084 | A1 | 3/2010 | Gibis et al. | |
| 2010/0200025 | A1 | 8/2010 | Housmekerides et al. | |
| 2012/0305584 | A1* | 12/2012 | Carson ..... | A61J 1/03 221/1 |
| 2013/0015095 | A1* | 1/2013 | Carson ..... | A61J 1/035 206/533 |
| 2014/0137898 | A1 | 5/2014 | Cabirol et al. | |

FOREIGN PATENT DOCUMENTS

| | | | |
|---|---|---|---|
| DE | 102012214607 | A1 | 2/2014 |
| DE | 102012214608 | A1 | 2/2014 |
| EP | 1315654 | A1 | 6/2003 |
| EP | 2546165 | A1 | 1/2013 |
| GB | 2386129 | A | 9/2003 |
| GB | 2417492 | A | 3/2006 |
| WO | WO-93/08095 | A1 | 4/1993 |
| WO | WO-93/15972 | A1 | 8/1993 |
| WO | WO-94/27868 | A2 | 12/1994 |
| WO | WO-01/07703 | A1 | 2/2001 |
| WO | WO-03/073907 | A2 | 9/2003 |
| WO | WO-2008/002041 | A1 | 1/2008 |
| WO | WO-2009/061933 | A1 | 5/2009 |
| WO | WO-2013/009852 | A1 | 1/2013 |
| WO | WO-2013/069037 | A1 | 5/2013 |
| WO | WO-2014/026855 | A1 | 2/2014 |
| WO | WO-2014/026856 | A1 | 2/2014 |

* cited by examiner

WEB OF CLEANING PRODUCTS AND METHOD OF MANUFACTURE

TECHNICAL FIELD

The present disclosure generally relates to packaging and, more particularly, to packaging for unit and multi-dose cleaning products.

BACKGROUND

Unit dose cleaning products are commonly used in dishwashing and other cleaning applications. A unit dose cleaning product typically comprises a water-soluble pouch filled with a cleaning composition (e.g., a powdered detergent, a liquid rinse aid, a water softener, etc.). Water used in a cleaning cycle, such as an automatic dishwasher cleaning cycle, dissolves the water-soluble pouch and releases the cleaning composition. The amount of cleaning composition inside each water-soluble pouch typically corresponds to the amount needed for a single cleaning cycle. Therefore, a user is not required to measure an appropriate amount of the cleaning composition for the cleaning cycle. This increases convenience to the user and makes accidental spills less likely. Also, enclosing the cleaning composition inside the water-soluble pouch reduces the risk of skin contact with the cleaning composition.

The exterior walls of the water-soluble pouch are typically very thin and thus susceptible to damage, particularly during transport and storage. If the water-soluble pouch is exposed to water, water vapor, oxygen, or any other potentially corrosive element prior to use, the water-soluble pouch may prematurely dissolve and release its contents. Furthermore, shifting and contact with other items during transport may inadvertently puncture the skin of the water-soluble pouch.

To protect the water-soluble pouches from damage prior to use, the water-soluble pouches are typically packaged within a laminated barrier bag. However, if one of the water-soluble pouches breaks inside the laminated barrier bag due to, for example, mechanical shock, the leaked contents of the damaged water-soluble pouch may compromise the other water-soluble pouches inside the laminated barrier bag. Also, the laminated barrier bag typically must have a re-sealing mechanism so that the consumer can re-seal the laminated barrier bag after removing one of the water-soluble pouches for use. Such re-sealing mechanisms increase the manufacturing costs and time associated with the laminated barrier bag. Also, laminated barrier bags tend to be bulky and difficult to stack, and thus oftentimes require a substantial amount of shelf space. Still further, a consumer must store the laminated barrier bag in a cabinet between uses, and must un-seal and re-seal the laminated barrier bag each time a water-soluble pouch is to be retrieved. This can be inconvenient and time-consuming for the user.

Furthermore, laminated barrier bags are typically made from materials (e.g., oriented polypropylene (OPP), biaxially oriented polypropylene (BOPP), polyethylene (PE), etc.) that fall under Classification #7 of the Standard Classification System for Specifying Plastic Materials. Such materials are generally difficult to recycle, making them undesirable from an environmental perspective.

SUMMARY

One aspect of the present disclosure provides a web of cleaning products including a carrier sheet and a plurality of internal and external lids. The carrier sheet may have a plurality of depressions each filled, and in direct contact with, at least one cleaning composition. The plurality of internal lids may correspond with the plurality of depressions and may be sealed to the carrier sheet to cover the plurality of depressions. The plurality of external lids may correspond with the plurality of internal lids and may be sealed to the carrier sheet to cover the plurality of internal lids.

Another aspect of the present disclosure provides a web of cleaning products including a water-resistant carrier sheet, a plurality of water-soluble pouches, and a plurality of water-resistant external lids. The water-resistant carrier sheet may have a plurality of pie-shaped depressions. The plurality of water-soluble pouches may each be positioned in a corresponding one of the plurality of pie-shaped depressions and contain at least one cleaning composition. The plurality of water-resistant external lids may be sealed to the carrier sheet and cover the plurality of pie-shaped depressions.

Yet another aspect of the present disclosure includes a method of making a web of cleaning products. The method includes: (a) forming a plurality of depressions in an upper surface of a first carrier sheet; (b) filling each of the plurality of depressions with at least one cleaning composition; (c) positioning a film to cover the first carrier sheet and sealing the film to the upper surface of the first carrier sheet about a rim of each of the plurality of depressions; (d) cutting the film to define a plurality of internal lids, each of the plurality of internal lids covering a corresponding one of the plurality of depressions; (e) removing an area of waste material produced by cutting the film to expose portions of the upper surface of the first carrier sheet; (f) positioning a second carrier sheet to cover the first carrier sheet and sealing the second carrier sheet to the exposed portions of the upper surface of the first carrier sheet; and (g) forming a plurality of weakened tear lines in the second carrier sheet to define a plurality of external lids, each of the plurality of external lids covering a corresponding one of the plurality of internal lids.

DETAILED DESCRIPTION

The present disclosure generally concerns the manufacture of a web of cleaning products that can endure multiple cleaning cycles and which is configured to release multiple doses of a cleaning composition one at time over the course of several cleaning cycles. This configuration allows a user to leave the web inside a cleaning environment, such as an automatic dishwasher, throughout multiple cleaning cycles, without premature release of its internal contents. Only the cleaning product(s) opened by the user prior to the cleaning cycle have their contents released during the cleaning cycle. The remaining cleaning products are protected inside the web until they are opened. Accordingly, the presently disclosed web frees the user from having to store the web in a dry environment such as a cabinet between cleaning cycles. Conveniently, the user can store the web inside the cleaning environment, indefinitely, if so desired, without concern that the unused cleaning products will be released prematurely. In one embodiment, the web may be sized and dimensioned similar to a dish plate so that the web can be held by a dish rack, or other dish holder, of an automatic dishwasher. Accordingly, the dishwasher may not require modification to accommodate the web of cleaning products.

Figure 1:
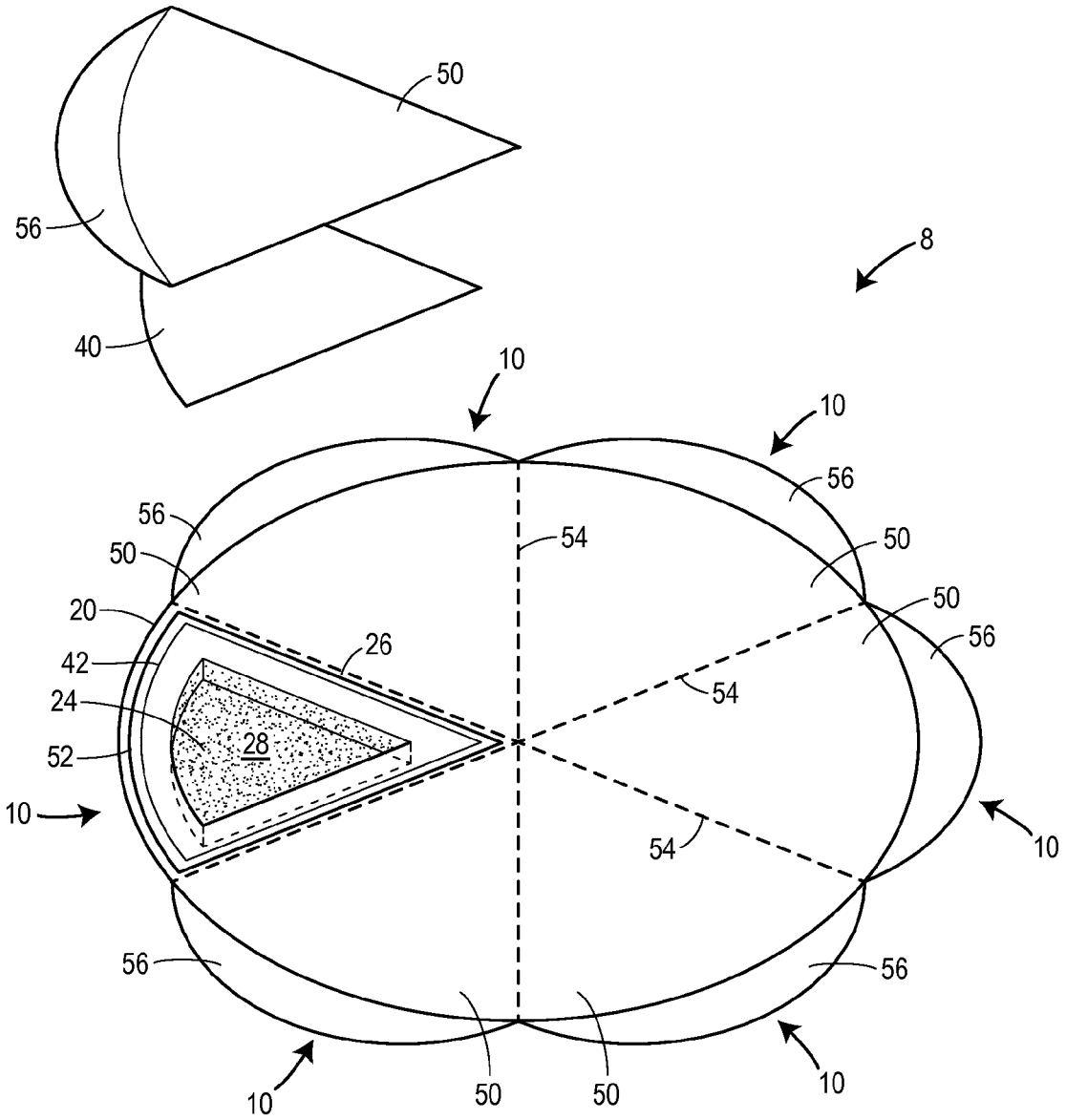
FIG. 1 is a perspective assembly view of one embodiment of a web of cleaning products constructed in accordance with principles of the present disclosure.
Figure 2:
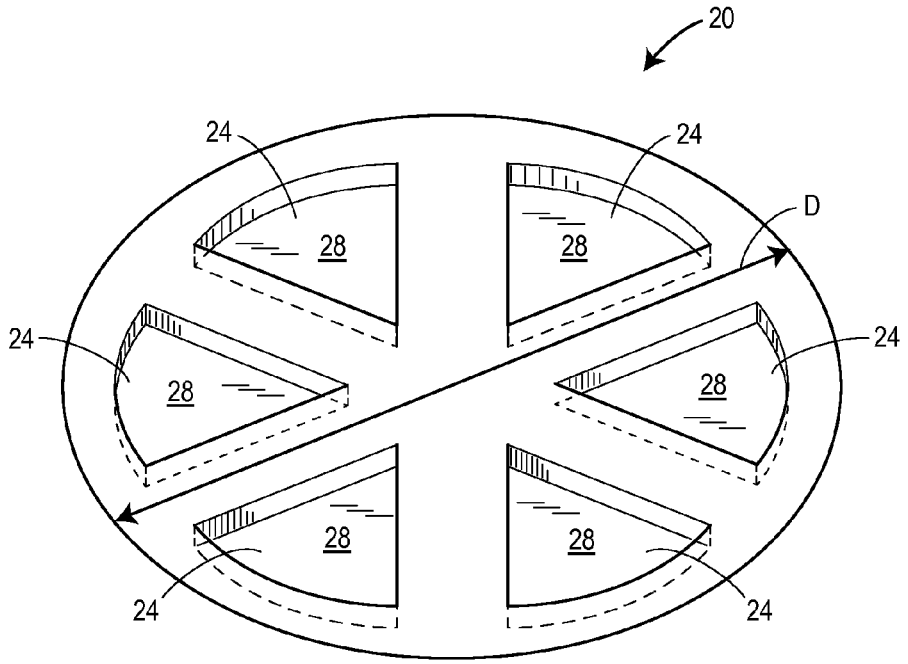
FIG. 2 is a perspective view of the web of cleaning products of FIG. 1 without the external and internal lids and without the cleaning compositions.

FIG. 1 illustrates one possible embodiment of a web 8 of cleaning products 10. The web 8 includes a carrier sheet 20 having a generally circular shape and a plurality of depressions 24 formed in its upper surface 26. As depicted in FIG. 2, the depressions 24 may be arrayed across the carrier sheet 20 in a pattern resembling slices of a pie. As a result, each depression 24 defines a respective sector of the circular shape of the carrier sheet 20, with the lateral sides of each depression 24 extending along respective imaginary radial lines emanating from the center of the carrier sheet 20. Other arrangements of the depressions 24 are envisioned, including a pattern of parallel and aligned rows and columns of the depressions 24. Also, as an alternative to the pie-shaped cross-section, the depressions may have a cross-section that is circular, square, rectangular, polygonal, or any other suitable shape.

The outer diameter D of the carrier sheet 20 may be substantially similar to that of a dinner plate. Preferably, the outer diameter D is between approximately (e.g., ±10%) 10-35 cm or, more preferably, 15-30 cm or, most preferably, 20-26 cm. By dimensioning and shaping the carrier sheet 20 similar to a dinner plate, the carrier sheet 20 can more easily fit into a dish rack, or other dish holder, within an automatic dishwasher.

The carrier sheet 20 is preferably made of a water-resistant material (e.g., a water-insoluble, hydrophobic material such as plastic) and is preferably rigid. The rigidity of the carrier sheet 20 may enable the web 8 to be oriented in an upright configuration in a dish rack of a dishwasher without sagging under its own weight. The carrier sheet 20 may be capable of withstanding multiple cleaning cycles within an automatic dishwasher with little or no degradation. Preferably, the carrier sheet 20 is made of a material having a melting point above 100° C., and, more preferably, above 150° C., so that the carrier sheet 20 does not thermally deform during the heated drying cycle of an automatic dishwasher. Suitable materials for the carrier sheet 20 include, but are not limited to, polyester and nylon/polyethylene laminates, preferably in their amorphous form. The carrier sheet 20 may be made of a recyclable material (e.g., polyethylene terephthalate (APET), polypropylene, etc.) so that the environmental impact of disposing the carrier sheet 20 is reduced. The carrier sheet 20 may be made of a recyclable material (e.g., polyethylene terephthalate (APET), polypropylene, etc.) so that the environmental impact of disposing the carrier sheet 20 is reduced. In some embodiments, the carrier sheet 20 may be made of a carbon neutral, or substantially carbon neutral, material such as for example, a biopolymer or another material derived from a biomass source (e.g., sugar beets, potatoes, wheat, etc.). One example of a suitable carbon neutral material for the carrier sheet 20 is BIOFRONT® manufactured and sold by Teijin Limited. BIOFRONT® is a type of biopolymer produced from a plant-based feedstock, and in some embodiments, may have a stereocomplex crystalline structure. The thickness of the carrier sheet 20 may be within a range between approximately (e.g., ±10%) 60-1000 μm, or 170-750 μm, or lesser or greater. In one embodiment, the carrier sheet 20 is a water-resistant film that is 170 μm thick and made from amorphous polyester APET. The carrier sheet 20 may be thermoformed to create the depressions 24, as discussed below in more detail.

Each of the depressions 24 defines an internal cavity 28 that is filled with a cleaning composition 30. The cleaning composition 30 may be in direct contact with the walls of the depression 24 as illustrated in FIG. 1. While the depressions 24 illustrated in FIG. 1 each have a single cavity 28 filled with a single cleaning composition 30, other embodiments can be arranged differently, with each depression 24 being divided into multiple cavities by one or more internal walls, and with each cavity being filled with a different cleaning composition. An embodiment configured in this manner is discussed below in connection with FIG. 7.

The cleaning composition 30 may be any composition which is intended to be released in an aqueous environment. The cleaning composition 30 may be a dishwashing detergent, a laundry detergent, a water softener, a rinse aid, salt enzyme, bleach, a bleach activator, a surface cleaner, etc. The cleaning composition 30 may have disinfectant, antibacterial, or antiseptic properties. The cleaning composition 30 may take any appropriate form including, but not limited to, a liquid, a gel, a paste, a solid, granules, or a powder. In one embodiment, the cleaning composition 30 may take the form of a mull, consisting of a mixture of particles which are insoluble in a carrier (e.g., a mixture containing water-soluble particles and a glycerol or propylene glycol carrier incapable of dissolving the water-soluble particles).

Figure 3:
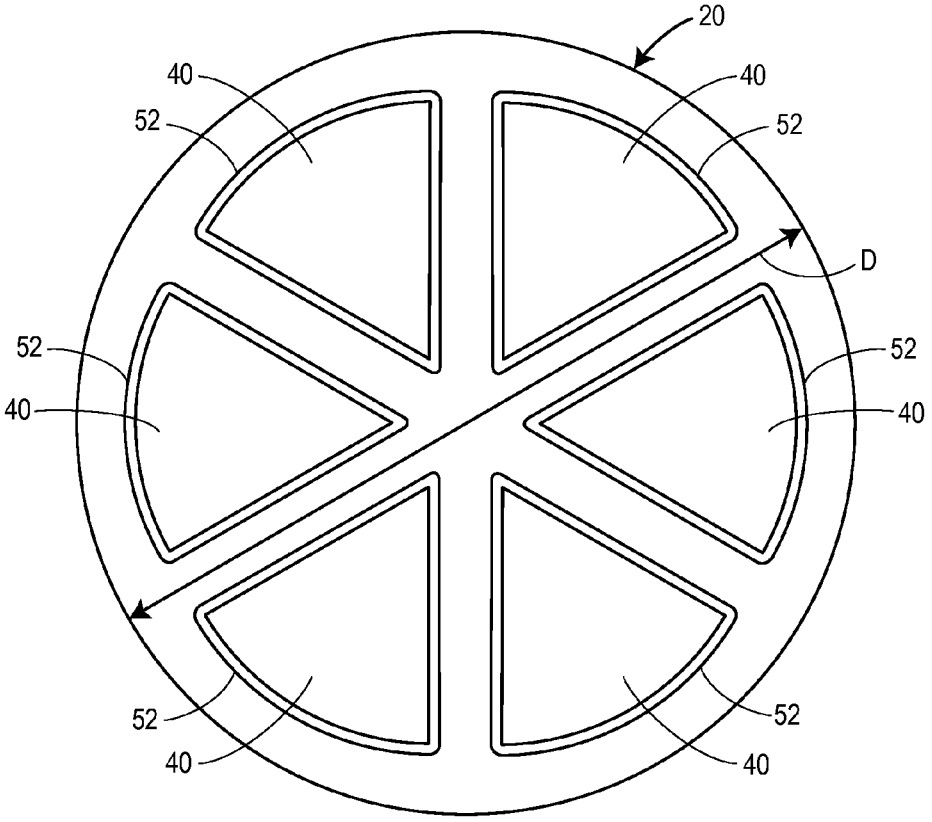
FIG. 3 is a top view of the web of cleaning products of FIG. 1 without its external lids.

Referring to FIG. 3, each of the depressions 24 may be covered with one of a plurality of internal lids 40. The internal lids 40 hold each dose of the cleaning composition 30 in its respective depression 24 prior to use. Each of the internal lids 40 may be sealed to the upper surface 26 of the carrier sheet 20 about the rim of a corresponding depression 24. A line of sealing material 42 may surround the rim of each of the depressions 24 to facilitate adhesion between the internal lids 40 and the upper surface 26 of the carrier sheet 20. As an alternative, or as an addition, to the lines of sealing material 42, the internal lids 40 may be welded (e.g., heat welded, vibration welded, ultrasonic welded, radio frequency welded, solvent welded, or any combination thereof) to the carrier sheet 20. In one embodiment, the internal lids 40 may be radio frequency welded to the carrier sheet 20 with the use of radio frequency welding equipment and/or production methods made available by Stanelco PLC.

The shape of the internal lids 40 may correspond to that of the depressions 24. As depicted in FIGS. 1 and 3, each of the internal lids 40 may be pie-shaped like its corresponding depressions 24, and each may have lateral sides extending along respective imaginary radial lines emanating from the center of the carrier sheet 20. The area covered by each internal lid 40 may be larger than the footprint of its corresponding depression 24 such that the internal lid 40 covers and seals close the depression 24.

The internal lids 40 are preferably made of a water-soluble material (e.g., a hydrophilic material), may be flexible or rigid. The internal lids 40 may be cold-water soluble or hot-water soluble. A cold-water soluble material is one that is soluble in water at 20° C. or less, while a hot-water soluble material is one which is soluble in water at 60° or more. Material which is soluble between these temperatures can also be used. An internal lid 40 made of a cold-water soluble material may release the cleaning composition 30 in three minutes or less when placed in un-agitated water at 20° C. or less. An internal lid 40 made of a hot-water soluble material may release the cleaning composition 30 in three minutes or less when placed in un-agitated water at 60° or more.

The internal lids 40 may be made from a mono-layer film or a multi-layer laminated film that is cut into the individual internal lids 40. Furthermore, the internal lids 40 may be perfumed or colored to obtain aesthetically pleasing characteristics, or from any combination of these features. In some embodiments, the internal lids 40 may be transparent or translucent. In some embodiments, different internal lids 40 may be made of different grades, thicknesses, and/or materials.

Preferred materials for the internal lids 40 include polyvinyl alcohol (PVOH), cellulose derivatives such as cellulose ethers, polyglycolides, polylactides, and/or polylactide-polyglycolide copolymers. In cold water applications, hydroxypropyl methyl cellulose (HPMC), as well as any of the foregoing materials, may be used for the internal lids 40. The PVOH may be partially or fully hydrolyzed homopolymer of polyvinyl acetate (e.g., a copolymer of vinyl alcohol groups and vinyl acetate groups, or all vinyl alcohol groups). Additionally, the PVOH may be a partially or fully hydrolyzed modified PVOH (for example 1-10 mole % anionic copolymer comprising groups such as monomethyl maleate sodium salt or 2-Acrylamido-2-methylpropane sulfonate sodium salt. For example, the PVOH may be alcoholised or hydrolysed in a range between 40-100%, or between 70-92%, or between 88-92%. The degree of hydrolysis is known to influence the temperature at which the PVOH starts to dissolve in water. 88% hydrolysis corresponds to a film soluble in cold (e.g., room temperature) water, whereas 92% hydrolysis corresponds to a film soluble in warm water. The material for the internal lids 40 may also, in various embodiments, contain plasticizers and mold release agents, which may facilitate the manufacturing of the internal lids 40. The material may be produced by any process including, for example, extrusion, blowing, and/or casting. The material may be un-oriented, mono-axially oriented, or bi-axially oriented. If the layers are oriented, they usually have the same orientation, although their planes of orientation may differ.

The thickness of the internal lids 40 may be in a range between approximately (e.g., ±10%) 20-500 μm, or 30-300 μm, or 35-200 μm, or between 40-160 μm, or 40-150 μm, or 40-120 μm. In one embodiment, the internal lids 40 may be made of a PVOH film available as MonoSol M8630, and may have a thickness of approximately (e.g., ±10%) 75 μm.

Referring to FIG. 1, each of the internal lids 40 may be covered with a corresponding one of a plurality of external lids 50. The external lids 50 protect the internal lids 40 from potentially corrosive elements such as water, water vapor, oxygen, etc., as well as mechanical damage, prior to use. Each of the external lids 50 may be sealed to the upper surface 26 of the carrier sheet 20 about the outer peripheral edge of a corresponding internal lid 40. Accordingly, the surface area of the carrier sheet 20 covered by an external lid 50 may be larger than the surface area of the carrier sheet 20 covered by its corresponding internal lid 40. FIG. 1 illustrates that a line of sealing material 52 may surround the outer peripheral edge of the corresponding internal lid 40 to facilitate adhesion between the external lid 50 and the upper surface 26 of the carrier sheet 20. The lines of sealing material 52 may be made of a low tack peelable adhesive (e.g., a UV-curable acrylic oligomer) allowing the external lid 50 to be pulled away from the carrier sheet 20 by a user. As an alternative, or as an addition, to the lines of sealing material 52, the external lids 50 may be welded (e.g., heat welded, vibration welded, ultrasonic welded, radio frequency welded, solvent welded, or any combination thereof) to the carrier sheet 20. In one embodiment, the external lids 50 may be radio frequency welded to the carrier sheet 20 with the use of radio frequency welding equipment and/or production methods made available by Stanelco PLC.

The shape of the external lids 50 may correspond to that of the internal lids 40. As depicted in FIG. 1, the external lids 50 may be planar and pie-shaped like the internal lids 40. The area covered by each external lid 50 may be larger than the footprint of its corresponding internal lid 40 such that the external lid 40 can properly cover and seal close the internal lid 40.

The external lids 50 are preferably made of a water-resistant material (e.g., a water-insoluble, hydrophobic material such as plastic) and are preferably at least semi-rigid. In one embodiment, the external lids 50 are made of the same material as the carrier sheet 20. The external lids 50 may be capable of withstanding multiple cleaning cycles of an automatic dishwasher with little or no degradation. Preferably, the external lids 50 are made of a material having a melting point above 100° C., and, more preferably, above 150° C., so that the external lids 50 do not thermally deform during the heated drying cycle of an automatic dishwasher. Alternatively, the external lids 50 may be made of a material having a melting point below 100° C., for example, any temperature within a range between approximately (e.g., ±10%) 50-100° C. Suitable materials for the external lids 50 include polyester and nylon/polyethylene laminates, preferably in their amorphous form. The thickness of each of the external lids 50 may be within a range between approximately (e.g., ±10%) 60-1000 μm, or 170-750 μm, or lesser or greater. Preferably, the external lids 50 are made of a recyclable material (e.g., APET, polypropylene, etc.) so that the environmental impact of disposing the external lids 50 is reduced. In one embodiment, the external lids 50 are made of a water-resistant film that is 170 μm thick and made from amorphous polyester APET.

The external lids 50 may be made from a single sheet of material that is divided into sections by weakened tear lines 54, with each section corresponding to one of the external lids 50. Each weakened tear line 54 may form an outer peripheral edge of adjacent external lids 50, as illustrated in FIG. 1. The weakened tear lines 54 may be formed by any suitable method including, for example, laser etching and/or scoring. As shown in FIG. 1, each weakened tear line 54 may each extend along a respective imaginary radial lines emanating from the center of the carrier sheet 20.

The weakened tear lines 54 facilitate individual detachment of the external lids 50 from the web 8. A user can remove one of the external lids 50 to expose the internal lid 40 underneath without compromising the seal protecting the other internal lids 40. Following removal of the external lid 50, the exposed internal lid 40 may be dissolved by water in a cleaning cycle to release the cleaning composition 30 in the depression 24 underneath.

Figure 4:
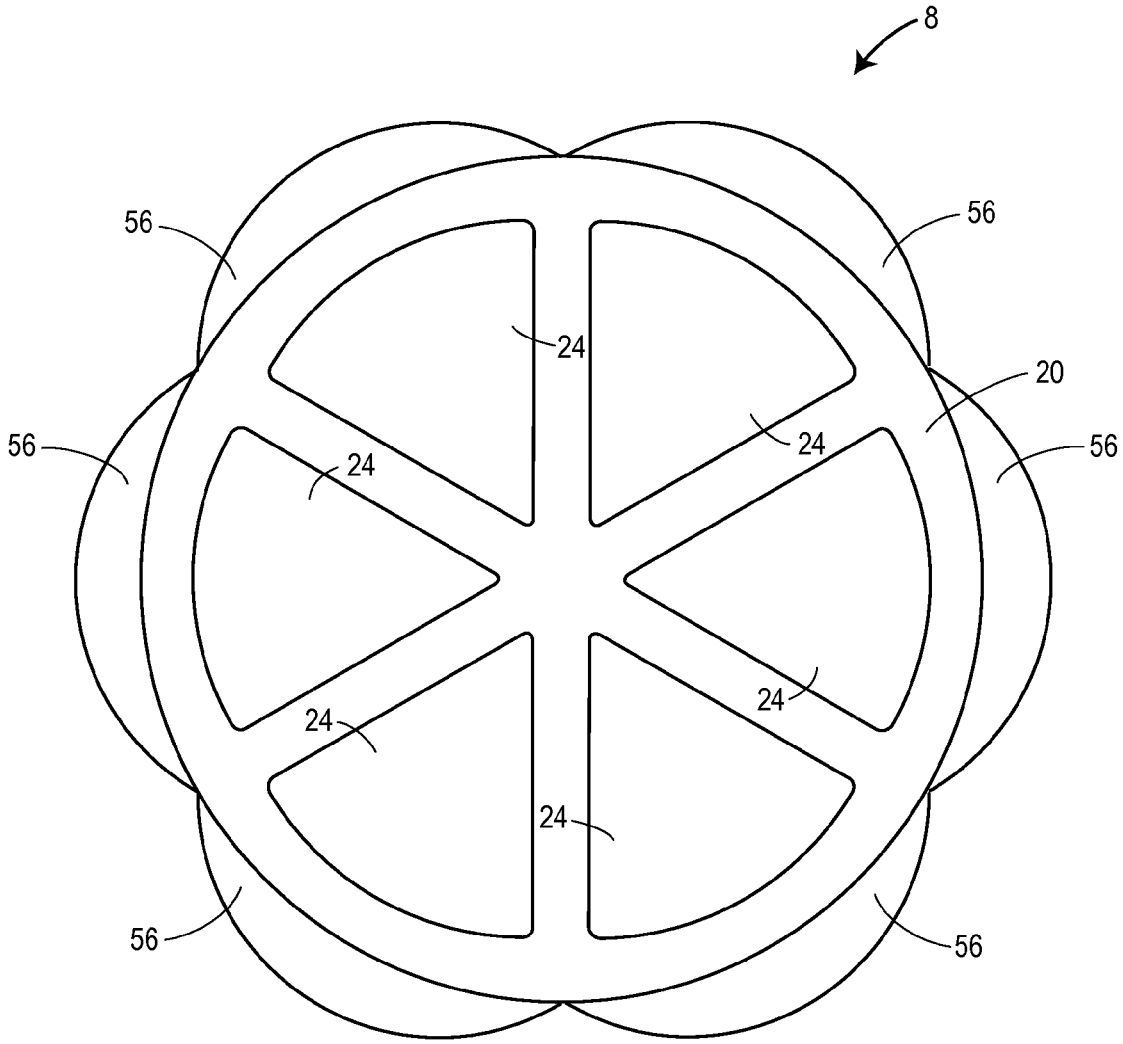
FIG. 4 is a bottom view of web of cleaning products of FIG. 1.

To facilitate removal of the external lids 50 from the web 8, each of the external lids 50 may be formed with a pull tab 56 that projects outwardly of the outer peripheral edge of the carrier sheet 20. FIG. 4 is a bottom view of the web 8 and illustrates the extension of the tabs 56 beyond the outer peripheral edge of the carrier sheet 20. A user may grip the pull tab 56 to pull and tear the external lid 50 from the web 8 and thereby expose one of the internal lids 40.

Each of the cleaning products 10 may be defined by the combination of one of the depressions 24, the cleaning composition 30 filling the depression 24, and the internal and external lids 40, 50 covering the depression 24. In some embodiments, each external lid 50 may cover two or more depressions 24 such that each cleaning product 10 is defined by the two or more depressions 24, two or more cleaning compositions 30, two or more internal lids 40, and a single external lid 50. In such an embodiment, each cleaning product 10 may include two or more different cleaning compositions, and the internal lids 40 of each cleaning product 10 may dissolve at a different rate. For example, one of the cleaning compositions within a cleaning product 10 may be dishwashing detergent, and the other one of cleaning compositions may be a water-softener, salt, enzyme, rinse aid, bleach, or bleach activator. The internal lid used for the water-softener, salt, enzyme, rinse aid, bleach, or bleach activator may dissolve at a faster rate than the internal lid used for the dishwashing detergent. Accordingly, the water-softener, salt, enzyme, rinse aid, bleach, or bleach activator may be released near the start of an automatic dishwasher cleaning cycle, whereas the dishwashing detergent may be released near the end of the automatic dishwasher cleaning cycle.

Various aspects of the web 8 of cleaning products 10 reduce the likelihood that a child will be able to access and/or want to ingest the cleaning composition 30. The weakened tear lines 54 may provide a first line of defense in that a small child may not have the gripping force to tear away one of the external lids 50 from the web 8. In some embodiments, the force needed to break the weakened tear lines 54 may be equal to or greater than approximately (e.g., ±10%) 250 N, or equal to or greater than approximately (e.g., ±10%) 300 N. Additionally, since the cleaning compositions 30 are hidden from view by the carrier sheet 20 and the external lids 50, colors and/or scents associated with the cleaning compositions 30 are less likely to tempt the child to open the web 8 in order to gain access to the cleaning compositions 30.

Secondary measures may also be implemented to ensure that, even if the child is able to remove one or more of the external lids 50, the child is prevented and/or deterred from bursting the internal lids 40 and/or ingesting the cleaning compositions 30. Such measures includes constructing the internal lids 40 to comply with some or all of the provisions set forth in the COMMISSION REGULATION (EU) No. 1297/2014 of 5 Dec. 2014 amended, for the purposes of its adaptation to technical and scientific progress, Regulation (EC) No. 1272/2008 of the European Parliament and of the Council on Classification. These provisions concern the safety of soluble packaging for detergents that are sold in dosages for single use by consumers. Among these provisions are requirements that the soluble packaging retain its contents for at least 30 seconds when the soluble packaging is placed in water at 20° C. Accordingly, in some embodiments, the film 80 used to construct the internal lids 40 may have the ability to retain the cleaning compositions 30 within their respective depressions 24 for at least 30 seconds when the internal lids 40 are exposed to water at 20° C. This characteristic of the internal lids 40 may reduce the risk the internal lids 40 will dissolve if momentarily placed in the mouth of a child. In addition, the internal lids 40 may be constructed with a bursting strength that is equal to or greater than approximately (e.g., ±10%) 250 N, or equal to or greater than approximately (e.g., ±10%) 300 N. This may prevent a child from bursting the internal lids 40 with his or her hands and/or teeth.

As a tertiary measure, the cleaning compositions 30 may include an orally-averse agent (e.g., a bittering agent) that deters a child from swallowing the cleaning compositions 30 in the event that the child is able to open the internal lids 40. An example of such an orally-averse agent is denatonium, which is commonly sold under the trade name Bitrex. Additionally, or alternatively, the orally-averse agent may be incorporated into the carrier sheet 20, the internal lids 40, and/or the external lids 50. The orally-averse agent may provide a last line of defense in the event that the foregoing childproof measures are not effective in preventing the child from gaining access to the cleaning compositions 30.

Additional childproof measures may be incorporated into the web 8 of cleaning products 10 and the foregoing discussion is not intended to limit the number or type of childproof measures suitable for use in the web 8 of cleaning products 10.

Figure 5:
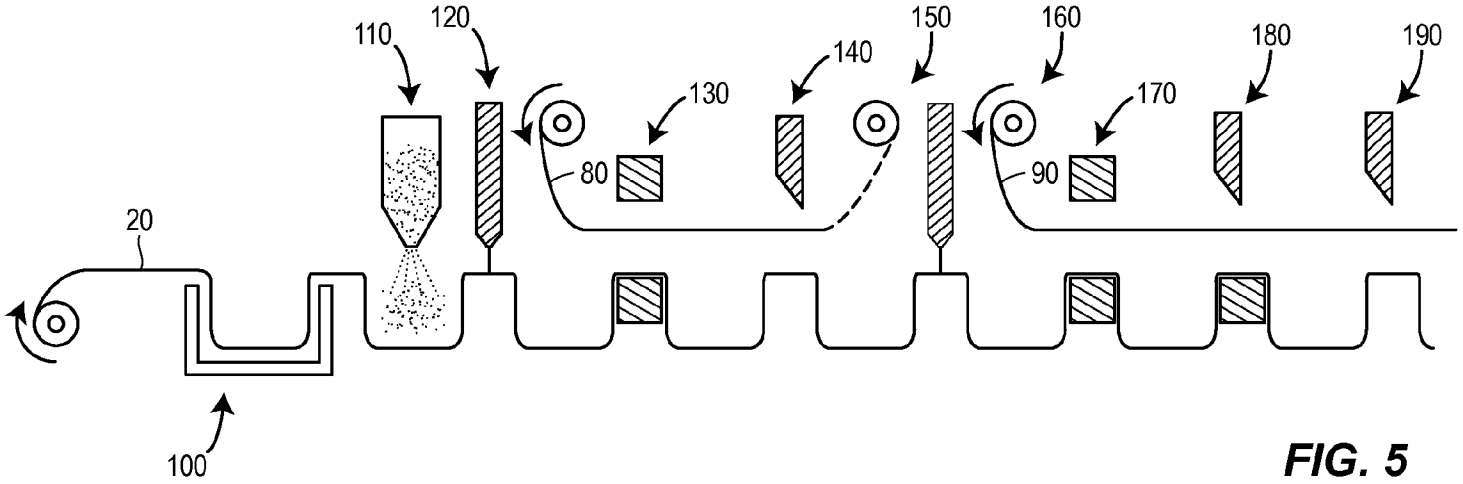
FIG. 5 is a schematic representation of one embodiment of a method of making a web of cleaning products in accordance with principles of the present disclosure.
Figure 6:
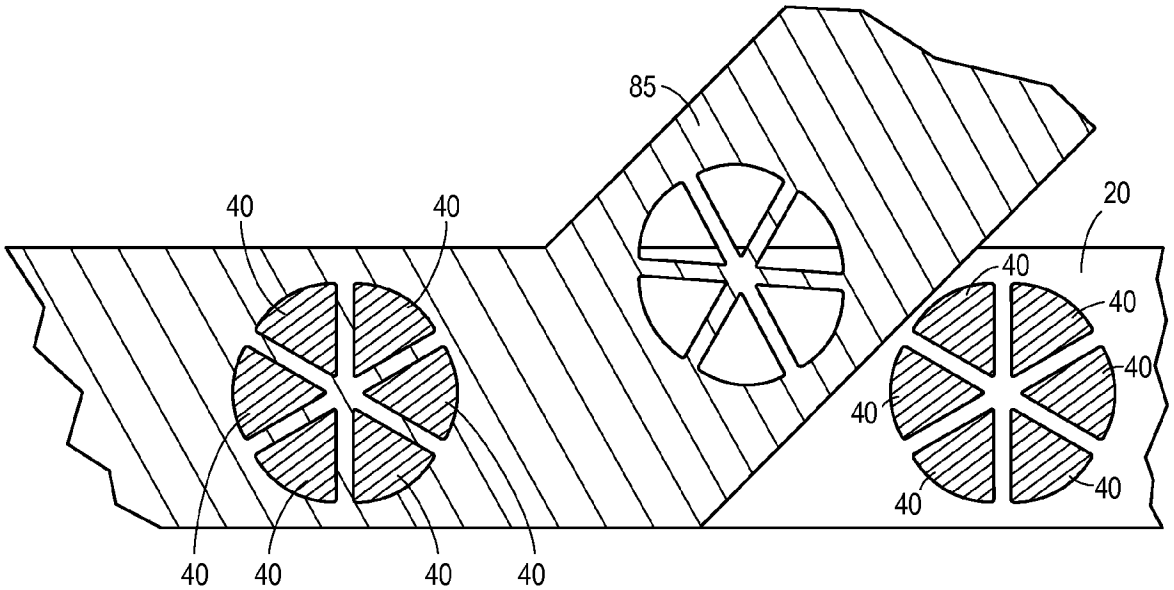
FIG. 6 is a schematic representation of cutting away excess portions of a film to create individual internal lids.

Referring to FIGS. 5 and 6, a method of manufacturing the web 8 of cleaning products 10 will now be described. FIG. 5 illustrates the carrier sheet 20 being fed from a roll into a thermoformer 100 where the depressions 24 are created in a thermoforming process. The thermoforming process may entail vacuum forming or pressure forming, or some combination of the two. Vacuum forming may involve heating the carrier sheet 20, pressing a mold against the carrier sheet 20, and vacuuming out air between the carrier sheet 20 and the mold so that the carrier sheet 20 assumes the shape of the mold. Pressure forming may involve heating the carrier sheet 20, pressing the carrier sheet 20 against a mold by vacuuming out air between the carrier sheet 20 and the mold, and applying positive air pressure above the carrier sheet 20 so that the carrier sheet 20 assumes the shape of the mold.

After the depressions 24 are formed, they are filled with the cleaning composition 30 by a filling machine 110. Each of the depressions 24 may be filled entirely or partially with the cleaning composition 30. Next, the lines of sealing material 42 may be applied to the upper surface 26 of the carrier sheet 20 at the sealing station 120. The lines of sealing material 42 may surround the rims of each of the depressions 24. The lines of sealing material 42 may be made of any suitable adhesive material including, for example, epoxies, polyurethanes, acrylics, and/or silicones.

Next, a film 80 for making the internal lids 40 is fed from a roll into face-to-face contact with the upper surface 26 of the carrier sheet 20, and pressed against the carrier sheet 20 at the pressing station 130. The film 80 adheres to the upper surface 26 of the carrier sheet 20 by virtue of the lines of sealing material 42. The adhesion of the film 80 to the carrier sheet 20 creates a seal around each of the depressions 24 to enclose the respective doses of cleaning composition 30.

Next, to convert the film 80 into individual internal lids 40, the film 80 is cut at the cutting station 140. This may be achieved by die-cutting through the film 80 around the rims of the depressions 24, but not through the underlying carrier sheet 20. Subsequently, the waste in-between material may be removed at a rewind station 150. FIG. 6 illustrates a plan view of this operation. After cutting the film 80 at the cutting station 140, the waste material 85 is removed upwards to the rewind station 150, leaving behind the separated internal lids 40 covering their respective depressions 24. Portions of the upper surface 26 of the carrier sheet 20 are exposed by this process. The cutting and removal process may be similar to that used in the flat bed die-cutting of self-adhesive labels (in which only the self-adhesive face material is cut, leaving the self-adhesive label adhering to the uncut siliconed release material).

Once the internal lids 40 have been cut and the waste material 90 removed, the lines of sealing material 52 may be applied to the exposed portions of the upper surface of the carrier sheet 20 at the sealing station 160. Each of the internal lids 40 may be surrounded by a line of sealing material 52. Suitable materials for the lines of sealing material 52 may be made of any suitable adhesive material including, for example, epoxies, polyurethanes, acrylics, and/or silicones. In one embodiment, the lines of sealing material 52 may be made of a low tack peelable adhesive (e.g., a UV-curable acrylic oligomer), which allows the external lids 50 to be pulled away from the carrier sheet 20 by a user.

Next, a carrier sheet 90 is fed from a roll into face-to-face contact with the upper surface 26 of the carrier sheet 20 and the internal lids 40, and pressed against the carrier sheet 20 at the pressing station 170. The carrier sheet 90 adheres to the upper surface 26 of the carrier sheet 20 by virtue of the lines of sealing material 52. The adhesion of the carrier sheet 90 to the carrier sheet 20 results in a seal around each of the internal lids 40.

Subsequently, the weakened tear lines 54 may be formed in the carrier sheet 90 at the cutting station 180. The weakened tear lines 54 may divide the carrier sheet 90 into the external lids 50. The weakened tear lines 54 may be formed by any suitable method including, for example, laser etching and/or scoring. As illustrated in FIG. 1, the weakened tear lines 54 may be formed along respective radial lines each extending from a center of the carrier sheet 20.

As final step, the carrier sheet 20 and the overlapping carrier sheet 90 may be cut into a circular shape, or any other suitable shape, at the cutting station 190, thereby creating the web 8 of cleaning products 10. In one embodiment, the cutting operation may produce a web having a hexagonal, heptagonal, or octagonal outer peripheral edge, or any other substantially circular shape.

The web 8 of cleaning products 10 can be implemented in a variety of different cleaning applications including an automatic dishwasher. In such implementations, a user may place the web 8 in a rack, or other holder, inside the dishwasher that is typically used to hold a dish plate. As such, the web 8 may be arranged alongside and/or between the dish plates during the cleaning cycle. Prior to the start of the cleaning cycle, a user may grip one of the tabs 56 and tear a corresponding one of the external lids 50 along the weakened tear lines 54. As a result, the internal lid 40 underneath is exposed. Dirty dishes may then be loaded into the dishwasher, and the cleaning cycle may be initiated. Water used by the dishwasher in the cleaning cycle dissolves the internal lid 40, thereby releasing the cleaning composition 30 of the depression 24 covered by the internal lid 40. The cleaning compositions 30 of the other depressions 24 remain sealed and protected within the web by virtue of the un-detached external lids 50 and the carrier sheet 20. When the cleaning cycle is completed, the user may remove the cleaned dishes, while leaving the web 8 inside the dishwasher. Accordingly, the user does not have to store the web 8 in a cabinet between uses. Later, when another load of dirty dishes requires cleaning, the user may repeat the foregoing process by removing another one of the external lids 50 of the web 8.

Figure 7:
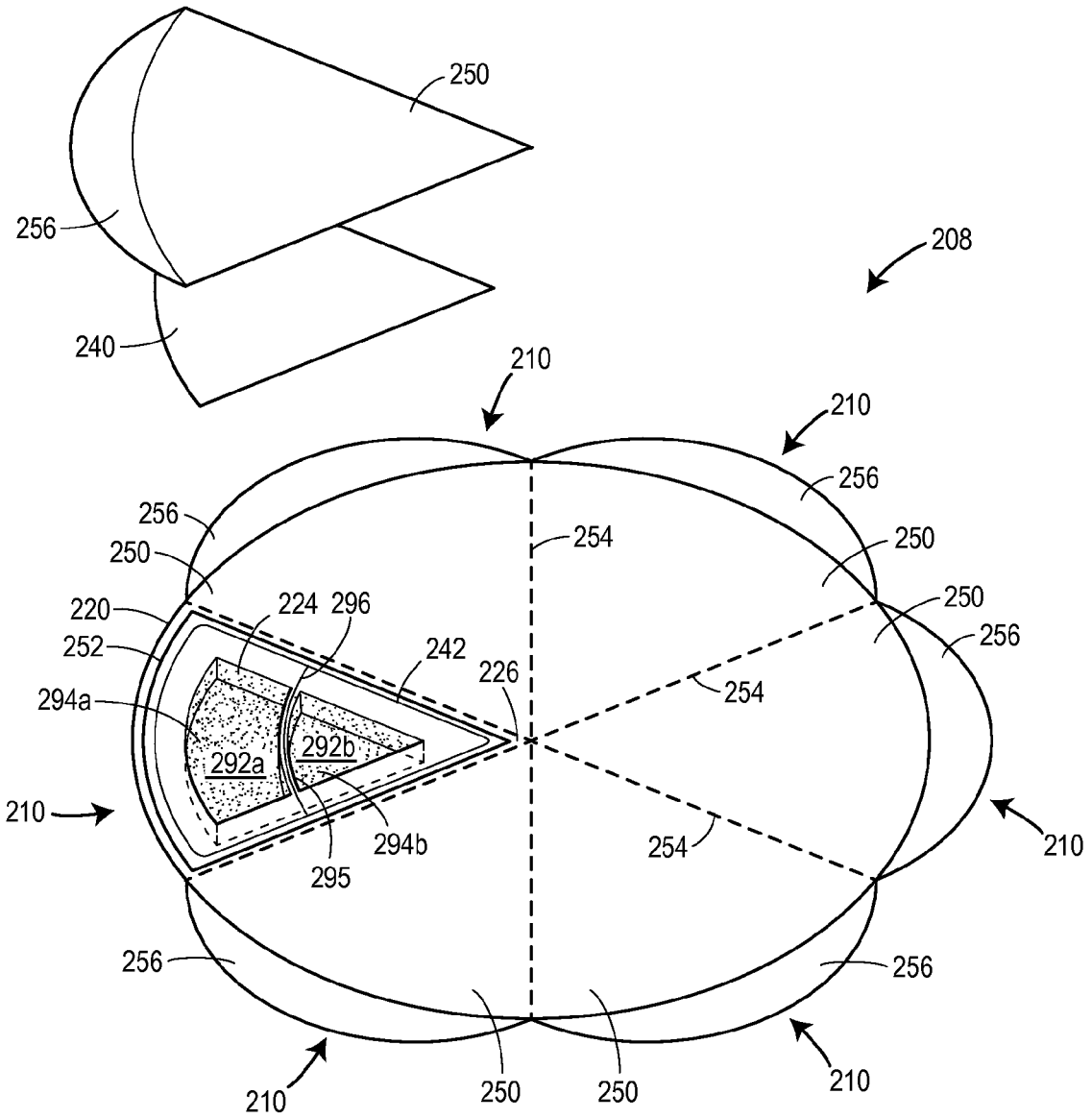
FIG. 7 is a perspective view of another embodiment of a web of cleaning products constructed in accordance with principles of the present disclosure.

Referring to FIG. 7, a second embodiment of the web 208 of cleaning products 210 will now be described. The foregoing description of the first embodiment of the web 8 is applicable to similar elements of the second embodiment of the web 208. Similar elements of the second embodiment have the same reference numeral as their first embodiment counterpart, with the addition of the digit "2" as a prefix.

The primary difference between the first and second embodiments is that each depression 224 of the second embodiment has multiple internal cavities 292*a*, 292*b*, each of which contains a different cleaning composition 294*a*, 294*b*. The internal cavities 292*a*, 292*b* are divided by an internal dividing wall 295 that extends between opposite perimeter walls of the depression 224. The different cleaning compositions 292*a*, 292*b* may perform functions that complement each other during a cleaning cycle. For example, the cleaning composition 292*a* may be a dishwashing detergent, whereas the cleaning composition 292*b* may be a water-softener, salt, enzyme, rinse aid, or bleach activator. An additional line of sealing material 296 may be applied across the upper surface of the internal dividing wall 295. The line of sealing material 296 adheres to the internal lid 240 to keep the cleaning compositions 292*a*, 292*b* in their respective cavities 292*a*, 292*b* prior to dissipation of the internal lid 240. While each depression 224 of the second embodiment is divided into two cavities, in other embodiments, each depression may be divided into three or more cavities, each containing a different cleaning composition.

Figure 8:
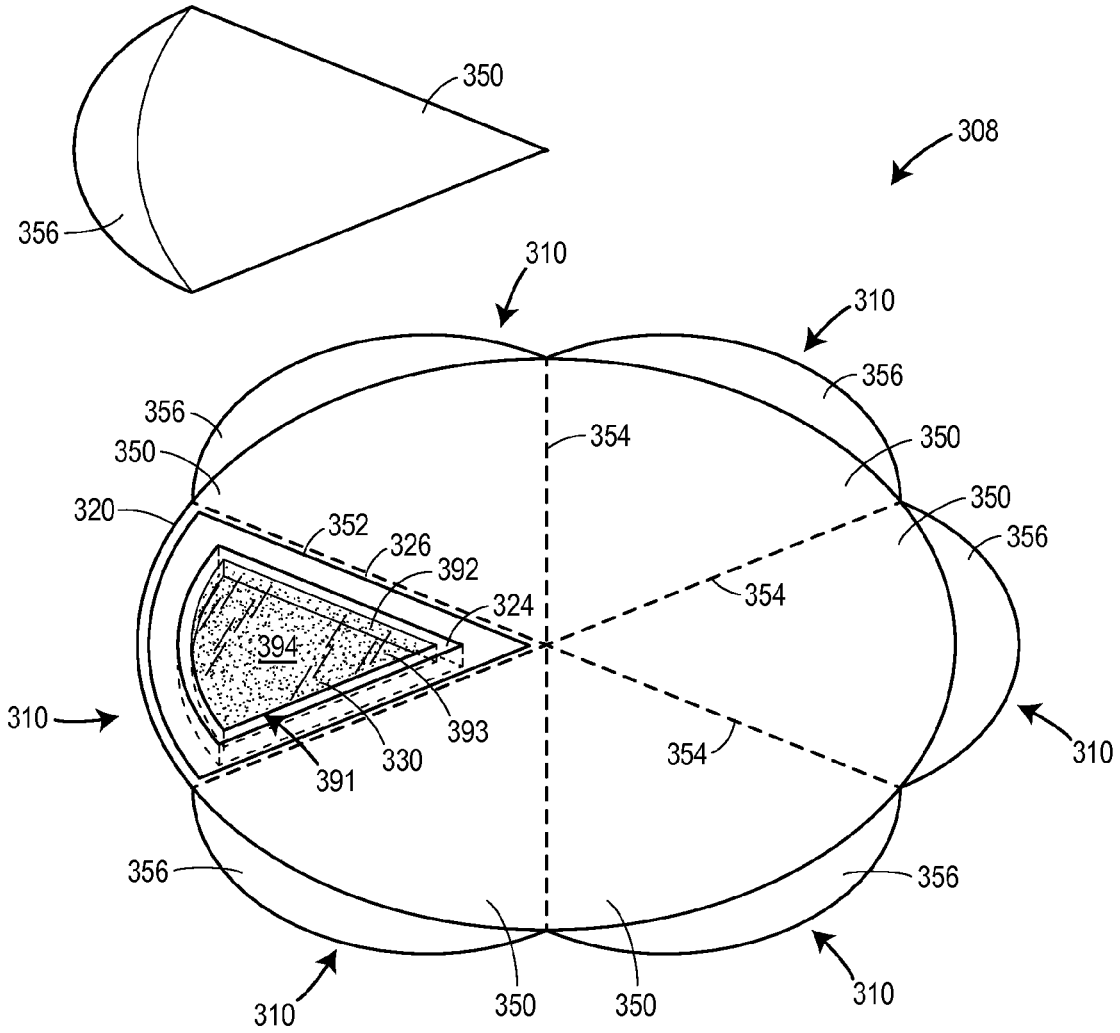
FIG. 8 is a perspective view of another embodiment of a web of cleaning products constructed in accordance with principles of the present disclosure.

Turning to FIG. 8, a third embodiment of a web 308 of cleaning products 310 will now be described. The foregoing description of the first embodiment of the web 8 is applicable to similar elements of the third embodiment of the web 308. Similar elements of the third embodiment have the same reference numeral as their first embodiment counterpart, with the addition of the digit "3" as a prefix.

The primary difference between the first and third embodiments is that each depression 324 of the third embodiment contains a pouch 391 filled with a cleaning composition 330. The cleaning composition 330 therefore does not directly contact the walls of the depression 324. Also, the third embodiment of the web 308 does not include a plurality of internal lids sealed to the carrier sheet 320 about a rim of each of the depressions 324.

Each pouch 391 may be formed by an internal holder 392 and an internal lid 393. The internal holder 392 may have a cavity 394 that holds the cleaning composition 330. The internal lid 393 may be sealed to the rim of the open end of the internal holder 392. As illustrated in FIG. 8, each pouch may be pie-shaped and correspond to the shape of its depression 324.

The internal holders 393 may be created by thermoforming a first film together with the carrier sheet 320 at the same time, in the manner as described in U.S. Patent Publication No. 2004/0142131, which is hereby incorporated by reference in its entirety. This process creates a temporary, or permanent, affinity between the first film and the carrier sheet 320 that reduces the effects of shrink-back, as discussed in U.S. Patent Publication No. 2004/0142131. Accordingly, it may be possible to fill the entire volume of each of the internal holders 393 will the cleaning composition 330. Once filled, internal holders 393 may be sealed shut by sealing a second film to the rims of the internal holders 393. Subsequently, the individual pouches 391 may be separated from each other by die-cutting through the second film, but not through the underlying carrier sheet 320, and then removing the waste in-between material resulting from the cutting operation. The cutting process may be similar to the one described U.S. Patent Publication No. 2004/0142131.

The first and second films may each be made from the same material as the internal lid 40 described above. Accordingly, the pouches 391 formed by the first and second films may be water-soluble. The carrier sheet 320 may be water-resistant and made from the same material(s) as the carrier sheet 20 described above.

The third embodiment of the web 308 may be used in the same manner as the first embodiment of the web 8, for example, by being stored inside a dishwasher over the course of multiple cleaning cycles. Also, since each does of the cleaning composition is enclosed within one of the pouches 391, the web 308 can be stored in a cabinet, and the user can retrieve a pouch 391 for use in a cleaning cycle without having to remove the web 308 from the cabinet. Accordingly, the third embodiment of the web 308 provides additional flexibility in how it is used by the consumer.

From the foregoing, it can be seen that the disclosed embodiments advantageously provide improved configurations and methods of forming a web of cleaning products. The ability to leave the leave the web of cleaning products within a cleaning environment during multiple cleaning cycles eliminates the need to store the cleaning products in a dry environment prior to their use. Instead, the user can simply place the web of cleaning products within the cleaning environment, and store it there, if so desired, until all of its cleaning products have been released. Also, since the web of cleaning products can be dimensioned and shaped like a dish plate, the web of cleaning products can be held by a dish rack, or other dish holder, of a conventional automatic dishwasher. Accordingly, dishwashers should not require modification to accommodate the web of cleaning products of the present disclosure. Still further, the web of cleaning products can be configured such that each cleaning product contains two or more different cleaning compositions, releasable at time different times during a cleaning cycle, which can improve cleaning efficiency. Also, since the protective, water-resistant portions of the web can be made of a recyclable material, the environmental impact of disposing the web, after dispersal of the cleaning compositions, is reduced.

While the present disclosure has been described with respect to certain embodiments, it will be understood that variations may be made thereto that are still within the scope of the appended claims.

What is claimed is:

1. A web of cleaning products comprising:

a water-resistant carrier sheet having a circular outer peripheral edge, a mean outer diameter in a range of approximately 10-35 cm, and a plurality of pie-shaped depressions arranged about a center of the water-resistant carrier sheet such that an outer edge of each of the plurality of pie-shaped depressions follows the circular outer peripheral edge of the water-resistant carrier sheet, each filled and in direct contact with at least one cleaning composition;

a plurality of internal lids corresponding with the plurality of depressions and being sealed to the carrier sheet to cover the plurality of depressions; and a plurality of external lids corresponding with the plurality of internal lids and being sealed to the carrier sheet to cover the plurality of internal lids.

2. The web of claim 1, each of the plurality of external lids including an outer peripheral edge defined by a weakened tear line allowing a user to individually remove the plurality of external lids from the web one at a time.

3. The web of claim 2, each of the plurality of external lids including a pull tab that projects outwardly of an outer peripheral edge of the carrier sheet and facilitates removal of the associated external lid.

4. The web of claim 1, each of the plurality of depressions being divided into two or more cavities each filled with a different cleaning composition.

5. The web of claim 1, the external lids being made of a water-resistant material.

6. The web of claim 5, the internal lids being made of a water-soluble material.

7. The web of claim 1, each of the plurality of external lids being separately sealed to the carrier sheet such that removal of one of the external lids does not compromise the seal of the remaining external lids.

8. The web of claim 1, each external lid covering a larger surface area of the carrier sheet than its corresponding internal lid.

9. The web of claim 1, the carrier sheet being made of a rigid material.

10. A web of cleaning products comprising:

a water-resistant carrier sheet having a circular outer peripheral edge and a plurality of pie-shaped depressions arranged about a center of the water-resistant carrier sheet such that an outer edge of each of the plurality of pie-shaped depressions follows the circular outer peripheral edge of the water-resistant carrier sheet and wherein the circular outer peripheral edge of the water-resistant carrier sheet has a mean outer diameter in a range of approximately 10-35 cm;

a plurality of water-soluble pouches each positioned in a corresponding one of the plurality of pie-shaped depressions and containing at least one cleaning composition; and a plurality of water-resistant external lids sealed to the carrier sheet and covering the plurality of pie-shaped depressions.

11. The web of claim 10, each of the plurality of water-resistant external lids including an outer peripheral edge defined by a weakened tear line allowing a user to individually remove the plurality of water-resistant external lids from the web one at a time.

12. The web of claim 11, each of the plurality of water-resistant external lids including a pull tab that projects outwardly of an outer peripheral edge of the water-resistant carrier sheet and facilitates removal of the associated water-resistant external lid.

13. The web of claim 10, each of the plurality of pie-shaped depressions containing two or more water-soluble pouches.

14. The web of claim 10, the at least one cleaning composition being at least one of a dishwashing detergent, a water softener, or a rinse aid.

15. The web of claim 10, each of the plurality of water-resistant external lids being separately sealed to the water-resistant carrier sheet such that removal of one of the external lids does not compromise the seal of the remaining external lids.

16. The web of claim 10, the water-resistant carrier sheet being made of a rigid material.

17. The web of claim 10, the plurality of water-resistant external lids being sealed directly to the water-resistant carrier sheet and not being sealed to plurality of water-soluble pouches.

18. The web of claim 10, each of the plurality of water-soluble pouches having a pie-shape corresponding to that of the pie-shaped depression in which the water-soluble pouch is positioned.

19. A method of making a web of cleaning products, the method comprising:

forming a plurality of pie-shaped depressions in an upper surface of a first water-resistant carrier sheet, the carrier sheet having a circular outer peripheral edge, a mean outer diameter in a range of approximately 10-35 cm, and the plurality of pie-shaped depressions arranged about a center of the water-resistant carrier sheet such that an outer edge of each of the plurality of pie-shaped depressions follows the circular outer peripheral edge of the water-resistant carrier sheet;

filling each of the plurality of depressions with at least one cleaning composition;

positioning a film to cover the first carrier sheet and sealing the film to the upper surface of the first carrier sheet about a rim of each of the plurality of depressions;

cutting the film to define a plurality of internal lids, each of the plurality of internal lids covering a corresponding one of the plurality of depressions;

removing an area of waste material produced by cutting the film to expose portions of the upper surface of the first carrier sheet;

positioning a second carrier sheet to cover the first carrier sheet and sealing the second carrier sheet to the exposed portions of the upper surface of the first carrier sheet; and forming a plurality of weakened tear lines in the second carrier sheet to define a plurality of external lids, each of the plurality of external lids covering a corresponding one of the plurality of internal lids.

20. The method of claim 19, each of the plurality of external lids including a pull tab that projects outwardly of an outer peripheral edge of the first carrier sheet and allows a user to individually remove the plurality of external lids from the web.

21. The method of claim 19, comprising cutting the first carrier sheet to form the circular outer peripheral edge.

22. The method of claim 21, forming each of the plurality of weakened tear lines along respective radial lines extending from a center of the circular shape of the first carrier sheet.

23. The method of claim 19, comprising forming each of the plurality of depressions with two or more cavities, and filling the two or more cavities with different cleaning compositions.

24. The method of claim 19, the second carrier sheet being made of a water-resistant material.

25. The method of claim 24, the film being made of a water-soluble material.

* * * * *